United States Patent [19]

Bingel et al.

[11] 4,370,225

[45] Jan. 25, 1983

[54] DRY MAGNETIC SEPARATORS FOR INCREASED RECOVERY OR ORE AT HIGH BELT SPEEDS

[75] Inventors: John P. Bingel, Lander, Wyo.; Robert W. Salmi, Grand Rapids, Minn.

[73] Assignee: United States Steel Corporation, Pittsburgh, Pa.

[21] Appl. No.: 295,895

[22] Filed: Aug. 24, 1981

[51] Int. Cl.[3] ..... B03C 1/16; B03C 1/30

[52] U.S. Cl. ..... 209/40; 209/219; 209/225

[58] Field of Search ..... 209/218, 40, 219, 225, 209/231, 638, 636, 470, 478, 479

[56] References Cited

U.S. PATENT DOCUMENTS

| | | | |
|---|---|---|---|
| 464,816 | 12/1891 | Conkling | 209/231 |
| 676,841 | 6/1901 | Edison | 209/231 |
| 1,339,300 | 5/1920 | Swart et al. | 209/219 X |

FOREIGN PATENT DOCUMENTS

| | | | |
|---|---|---|---|
| 432490 | 9/1926 | Fed. Rep. of Germany | 209/231 |
| 472758 | 9/1937 | United Kingdom | 209/225 |

*Primary Examiner*—Ralph J. Hill

*Attorney, Agent, or Firm*—William F. Riesmeyer, III

[57] ABSTRACT

This invention relates to improvements in a dry magnetic separation system for increasing the recovery of magnetic ore from the feed material. The system includes a separator which has a magnetic head-pulley assembly mounted in one end of an endless belt conveyor loop. When the conveyor is run at high speeds some of the ore is thrown off the head-end of the belt instead of being retained on it by the magnetic pulley. Those ore particles that are retained are carried onto the lower flight of the belt from which they are dropped into an ore chute. To recover the magnetic portion of the "thrown" ore, an adjustable splitter is located outwardly of the pulley-head at a lower elevation than the belt. The splitter also directs these partially magnetic particles into the ore chute and the non-magnetics to a tailings chute. The improvements of the present invention increase the degree of separation by making the trajectory of thrown particles primarily a function of their magnetic content and eliminating other factors. The fine magnetic ore particles that lay on top of large non-magnetic particles are stratified to the bottom of the belt. Without the stratification, these fine magnetic particles would be lost to tailings with the large non-magnetic particles. The improvements include apparatus for vibrating the feed particles to stratify them by size, and apparatus for minimizing the depth of the feed layer by allowing it to progressively increase in width in the direction toward the magnetic head-pulley. Thus, a thin layer of feed stratified by size may be obtained so as to achieve better separation by magnetic attraction and trajectory at high belt speeds.

3 Claims, 3 Drawing Figures

DRY MAGNETIC SEPARATORS FOR INCREASED RECOVERY OR ORE AT HIGH BELT SPEEDS

BACKGROUND OF THE INVENTION

This invention relates to apparatus for separating magnetic ore from gangue, and particularly to improvements in magnetic head-pulley separators.

The commonly used separator has a horizontal or an upwardly inclined belt conveyor with a magnetic head-pulley at its upper end. At normal conveyor speeds magnetic particles adhere to, and are carried on the belt to an ore chute under the head-pulley. Non-magnetic gangue particles are thrown off the conveyor into another chute outwardly of the head-pulley.

It has been shown that production can be increased by running the belt at increased speeds and also increase the efficiency of separation. The higher speed and resultant thinner layer of ore increases the chances for a clean and high capacity separation. Although some magnetic particles will be thrown off the conveyor with the gangue, they will have different trajectories than the gangue, due to their magnetic attraction to the head-pulley. Thus, a splitter device appropriately placed outwardly of the head-pulley, will direct "thrown" magnetic particles into the ore chute, while non-magnetic gangue particles will continue to be collected by the splitter. However, the degree of separation and recovery at higher speeds can be further improved. Other factors affect the magnetic separation of the particles, not just their magnetic ore content.

It is therefore a primary object of this invention to provide improvements in magnetic pulley-head separators, so as to obtain better separation and recovery of magnetic ore at higher than normal belt speeds.

SUMMARY OF THE INVENTION

The conventional magnetic pulley-head separator includes an endless conveyor belt loop, a magnetic head-pulley within one end of the loop, means for driving the conveyor, and a splitter device located outward of the head-pulley. The improvements of this invention include means for vibrating the particles in the feed layer on the belt so as to stratify them by size (coarse on top, fines on the bottom). Means also is provided to minimize the depth of the feed layer, to encourage stratification during vibration, by allowing the layer to progressively increase in width on the belt in the direction toward the magnetic head-pulley. This feature avoids the capture of ore particles under the belt skirting and wear on the belt. Preferably, the vibrating means comprises means for periodically striking the conveyor belt to set up vibrations in the particle feed layer. For example, one or more idler rollers having longitudinal bars spaced along their outer circumference may be used under the top flight of the belt to set up the vibrations therein. Flexible skirting may be used to control the width and minimize the depth of the particle layer.

DESCRIPTION OF THE PREFERRED EMBODIMENT

Figure 1:
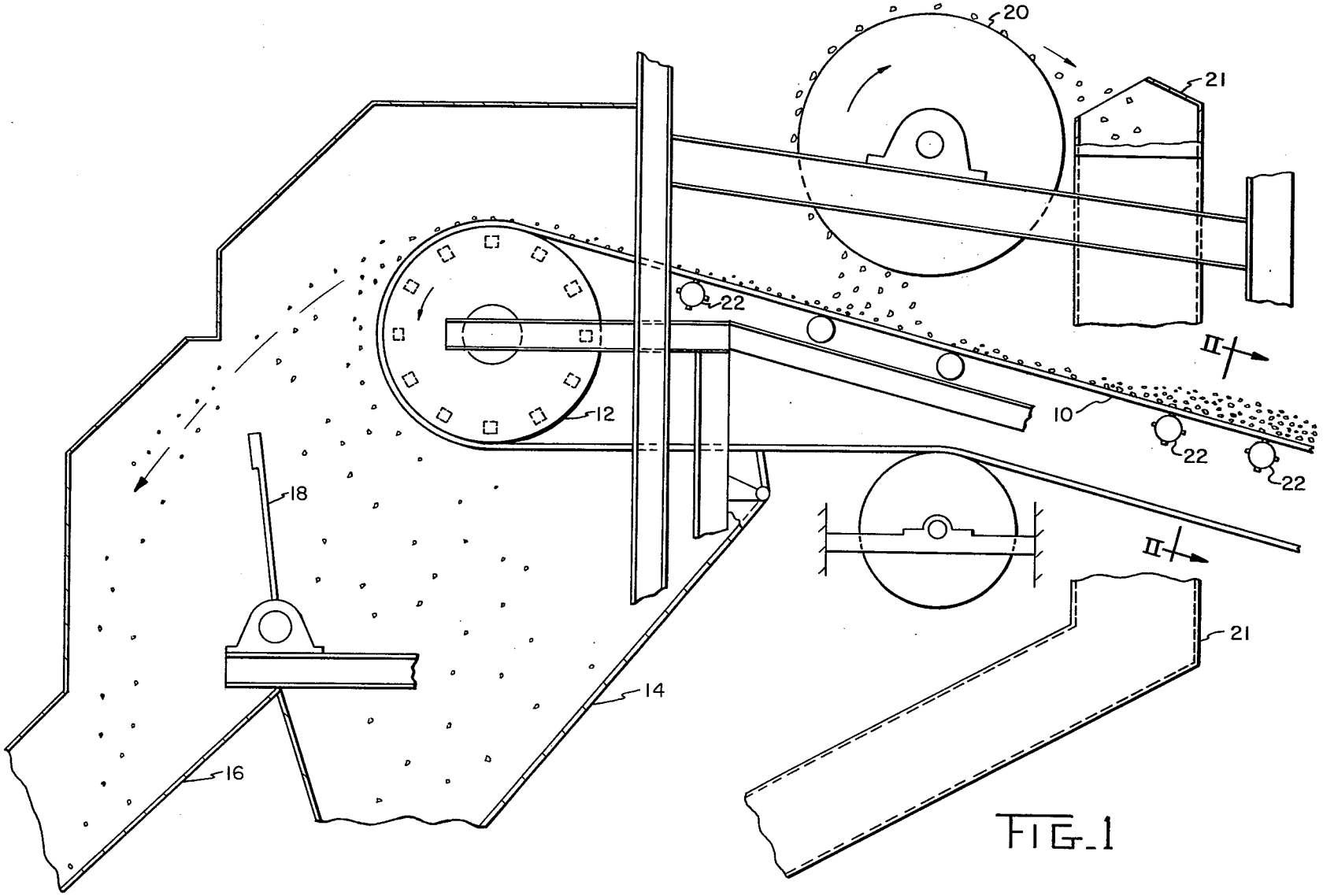
FIG. 1 is a side elevation view of a magnetic head-pulley and an overhead magnetic drum separator incorporating improvements according to the instant invention.
Figure 2:
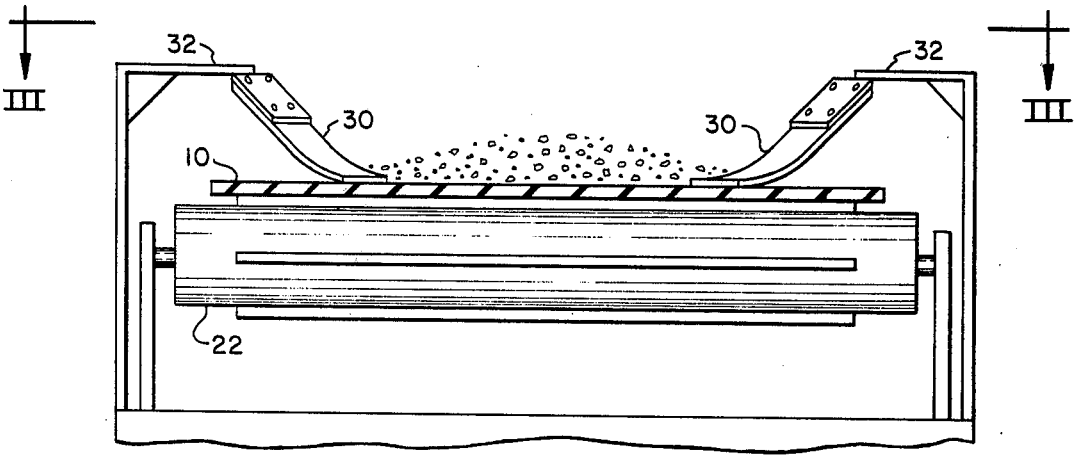
FIG. 2 is a view taken at II—II of FIG. 1.
Figure 3:
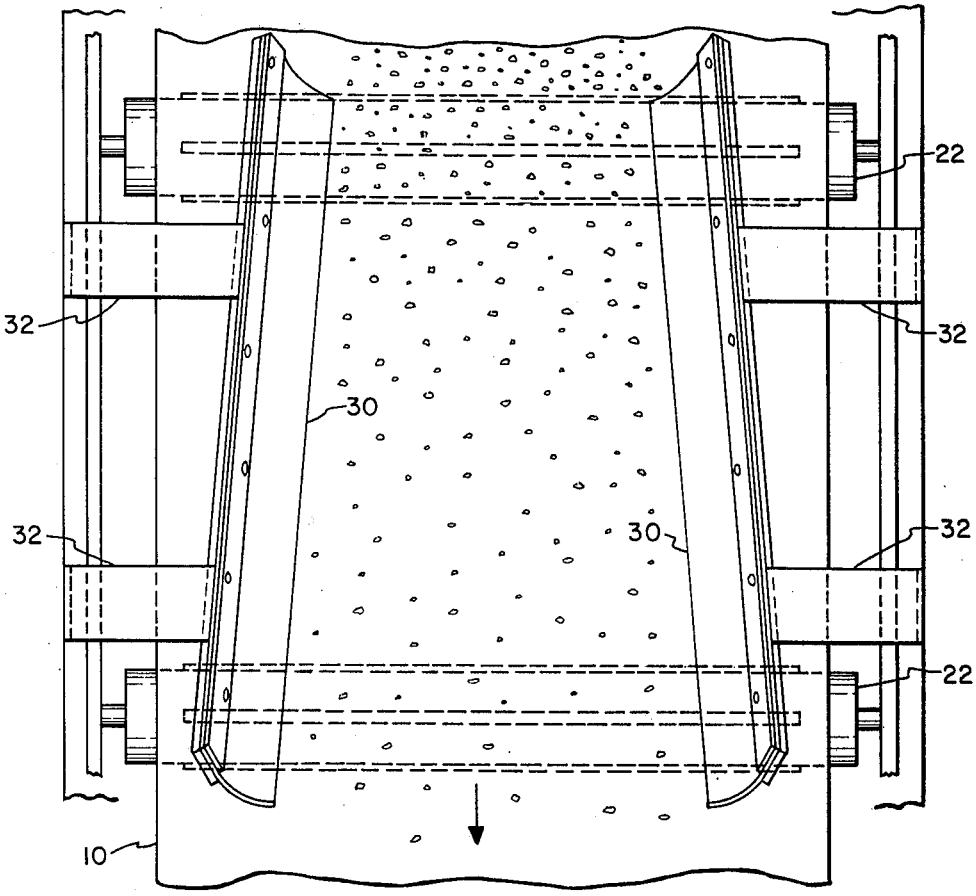
FIG. 3 is a partial top plan view of the conveyor belt of the separator shown in FIG. 1.

Referring to FIGS. 1, 2 and 3; magnetic separation apparatus is shown, including a driven endless conveyor belt 10. A permanent-magnet, belt-head pulley 12 (for example a Stearns radial-pole type) is located at the upper end of the loop. Particulate feed material, in our case magnetite ore, is delivered onto the belt by conventional devices (not shown). The feed is carried on the belt over head-pulley 12. At typical belt speeds, (400 fpm) strongly magnetic ore particles are held to the belt and are carried under the head-pulley to the lower conveyor flight. There, after passing the head-pulley 12 they drop off the belt into ore chute 14. Non-magnetic, gangue particles are not held to the belt and are thrown outwardly toward chute 16. Some of the less magnetic ore is also thrown off the belt outwardly of the head-pulley. An adjustable splitter 18 is used to separate magnetic ore from gangue since the two will have a different trajectory. An overhead magnet head-drum separator 20 may be used to lift larger strongly-magnetic ore particles from the belt and direct them to another ore chute 21. Drums of this type are readily available from Eriez Company. We use such apparatus to up-grade the magnetic content of feed for a rod mill which grinds the ore to finer size, after which it is further ground and magnetically concentrated and used to make pellets for blast furnace feed.

To further increase the effectiveness of separation of the ore from gangue at high belt speeds, we provide a series of rotatable idler rollers 22 abutting the underside of the top flight of belt 10. At least some of the rollers have 5/16" square keystock welded to their outer surface to provide projections for striking the belt as the rollers rotate, thus we refer to them as "bouncing idlers". The keystock bars are spaced at 90° locations around the roller surface and extend longitudinally parallel to the roller axis. It will be apparent that the size of the rollers as well as the size and number of keystock bars may be varied and selected according to the results obtained in any particular system. Moreover, other means of vibrating the particles should be considered within the scope of the invention, for example an alternating intermittent magnetic field may be provided to excite ore particles on the belt.

Flexible skirting 30 is provided for extending longitudinally along opposite side edges of the top flight of belt 10. This skirting may be rubber or similar material mounted in brackets 32 of well known type. The skirts are spaced apart so as to taper outwardly to greater width in the direction toward head-pulley 12 as shown in FIG. 3. Desirably the skirting material extends downwardly so as to engage belt 10 and lay inwardly facing the belt axis. Thus, as the particles bounce and stratify, in the apparatus shown, along with the belt 10 itself, they will not wedge under the skirting since it tapers outward. Moreover, wear of the belt and spillage of particles will be prevented. Again other means may be used to control and regulate the width and depth of the particle layer which will be apparent to those skilled in the art. For example, eccentric idlers or idlers of varying arc shape, or groups of idlers arranged in varying shapes may be provided to control belt shape, and thus the particle layer thickness and width.

These and other embodiments within the spirit and scope of the invention will readily be apparent to those skilled in the art and are intended to be covered by the following claims appended hereto.

We claim:

1. In magnetic ore particles separating apparatus, said apparatus including belt conveyor means, said conveyor including at least one endless belt loop, a head-pulley mounted within said loop at one end thereof, said pulley having magnet means for attracting said ore particles, means for driving said conveyor, and a splitter device located downwardly from said head-pulley and aligned outwardly of said loop so as to effect separation of particles by differences in trajectory and magnetic susceptibility when thrown off the head-pulley end of said loop, the improvement in said apparatus which comprises:

means for periodically striking said conveyor at at least one location of an upper flight of said belt intermediate said head-pulley and an opposite end thereof so as to effect stratification of said particles by size prior to their arrival at said head-pulley-end means for regulating the width of the layer of ore particles on said conveyor, said width tapering outwardly toward the side edges of said conveyor means in the direction toward the head-pulley, whereby, a thin layer of particles stratified by size is obtained at the head-pulley end of said conveyor, thus improving separation of magnetic from non-magnetic particles by differences in the trajectory and magnetic susceptibility thereof.

2. The apparatus of claim 1 wherein said striking means includes at least one idler roll abutting an underside of said upper flight of said belt, said roll having longitudinally extending protrusions at spaced locations on the outer periphery thereof for striking said belt.

3. The apparatus of claim 1 wherein said width regulating means includes spaced flexible skirting disposed above said conveyor, said skirting hanging downwardly to said conveyor and laying on the top surface of and facing inwardly toward the axis thereof.

* * * * *